United States Patent [19]

Hinzmann

[11] 3,996,943

[45] Dec. 14, 1976

[54] DISTRIBUTOR FOR CIGARETTE ROD MAKING MACHINES OR THE LIKE

[75] Inventor: Alfred Hinzmann, Richmond, Va.

[73] Assignee: Hauni-Werke Korber & Co., KG, Hamburg, Germany

[22] Filed: Apr. 17, 1975

[21] Appl. No.: 569,180

Related U.S. Application Data

[63] Continuation-in-part of Ser. No. 536,302, Dec. 24, 1974.

[52] U.S. Cl. ..... 131/21 A; 131/109 R; 131/110

[51] Int. Cl.[2] ..... A24B 7/14

[58] Field of Search ..... 131/21 A, 84 R, 84 C, 131/84 B, 109 R, 109 AB, 109 B, 110

[56] References Cited

UNITED STATES PATENTS

| | | | |
|---|---|---|---|
| 1,885,880 | 11/1932 | Wiener | 131/109 R |
| 1,977,991 | 10/1934 | Hawkins | 131/84 R X |
| 2,326,793 | 8/1943 | Molins et al. | 131/109 R |
| 3,794,049 | 2/1974 | Wochnowski | 131/21 A X |
| 3,871,385 | 3/1975 | David | 131/110 X |

*Primary Examiner*—John F. Pitrelli
*Attorney, Agent, or Firm*—Peter K. Kontler; John Kurucz

[57] ABSTRACT

A distributor for use in a cigarette rod making machine has a magazine for shredded tobacco, a carded drum which rotates about a horizontal axis and draws from the magazine a continuous layer of tobacco shreds toward its apex, a homogenizing device which equalizes the layer between the region where the shreds are being withdrawn from the magazine and the apex, a rapidly rotating picker roller which is adjacent to the apex of the drum and expels the shreds of the equalized layer tangentially from the carding of the drum whereby the flight spans of heavier tobacco particles exceed the flight spans of other tobacco particles. The other tobacco particles descend onto and form a sliver on a wide belt, and the heavier particles are intercepted by a receptacle. A second picker roller expels remnants of tobacco particles from the carding and transfers such particles onto the belt. The homogenizing device may include a strip which extends in parallelism with the axis of the drum and is reciprocated by an electric motor. The underside of the strip is grooved and contacts the exposed side of the tobacco layer, and the upper side of the strip is adjacent to the path of paddles on a rotating wheel serving to brush back into the magazine those tobacco shreds which accumulate at the rear side of the strip.

9 Claims, 1 Drawing Figure

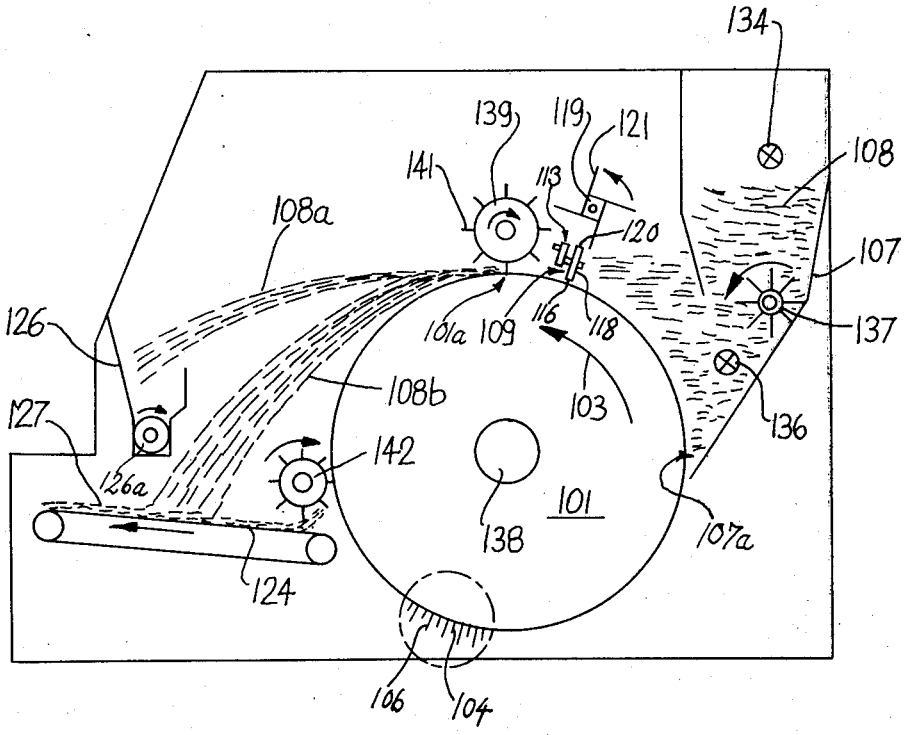
134
139
119
121
108
141
113
108a
120
107
126
101a
109
116
118
137
108b
103
136
127
142
126a
101
138
107a
124
106
104

DISTRIBUTOR FOR CIGARETTE ROD MAKING MACHINES OR THE LIKE

CROSS-REFERENCE TO RELATED APPLICATION

This is a continuation-in-part of my copending application Ser. No. 536,302 filed Dec. 24, 1974.

BACKGROUND OF THE INVENTION

The present invention relates to apparatus for producing and processing a continuous layer of fibrous particles, especially to improvements in distributors for shredded tobacco, and more particularly to improvements in apparatus which can be used in machines for the making of wrapped rod-like tobacco fillers as a means for converting a mass of tobacco shreds into a homogenized tobacco layer of uniform height and width so that the layer can be readily converted into a narrow tobacco stream.

The distributor of a cigarette rod making machine normally comprises a magazine for a supply of shredded tobacco, a carded drum which draws a continuous layer of tobacco particles from the magazine, means for segregating lightweight particles of the layer from heavier tobacco particles and for assembling the lightweight particles into a wide carpet or sliver, and means for showering or propelling the leading edge of the carpet into a narrow channel to form a continuous tobacco stream.

It was already proposed to enhance the homogeneousness of the layer which is being withdrawn from the magazine of a distributor for shredded tobacco by subjecting the layer to a series of smoothing, combing, compacting and surplus-removing treatments. Such treatments are expensive because they are carried out by resorting to relatively complex equipment having a substantial number of discrete units and occupying a substantial amount of space. Also, the just described treatment cannot invariably guarantee the formation of a tobacco layer which can be converted into a filler without any further treatment, especially without trimming by one or more sets of knives or analogous equalizing devices. Still further, the just described treatment does not guarantee the formation of a layer which is free of holes or gaps and wherein the homogenization is effected without any or with minimal comminution of tobacco shreds.

My copending application Ser. No. 536,302 discloses a distributor wherein the layer of tobacco shreads which is being withdrawn from a magazine by the carding of a rotary drum is equalized by novel homogenizing means which is preferably immediately or closely adjacent to the outlet opening of the magazine. The homogenizing means comprises a preferably strip-shaped barrier having a preferably profile (e.g., grooved) first surface which is adjacent to and in contact with the exposed side of the tobacco layer on the carded drum, and a second surface which is adjacent to the first surface and extends substantially transversely of the layer and faces toward the outlet of the magazine, i.e., counter to the direction of transport of the layer, whereby at least some particles of the layer which extend beyond the first surface are intercepted by and pile up at the second surface of the barrier. The homogenizing means further comprises means for moving the barrier back and forth substantially transversely of the path of movement of the layer so that the first surface of the barrier reciprocates along the exposed side of the layer, and a paddle wheel or analogous refuser means for moving the piled-up particles counter to the direction of movement of the layer, preferably directly back into the magazine.

The advantages of the just described homogenizing means can be summarized as follows:

The material which is being continuously withdrawn from the magazine is converted into a homogeneous layer in a small area, by resorting to a small number of simple instrumentalities and without any or with negligible comminution of tobacco shreds. The simple instrumentalities of the homogenizing means perform functions which are performed in conventional distributors by a larger number of bulkier, more complex and more expensive components. The homogenizing means can be installed in existing distributors of cigarette rod making or analogous machines.

SUMMARY OF THE INVENTION

An object of the present invention is to provide a distributor which constitutes a further developmennt of and an improvement over the distributor of my copending application Ser. No. 536,302.

Another object of the invention is to provide the distributor with novel and improved means for converting an equalized layer of tobacco shreds or analogous fibrous particles into a carpet or sliver in a novel and improved way and by resorting to fewer and simpler parts than in heretofore known distributors.

A further object of the invention is to provide the distributor with novel and improved means for classifying the particles of the homogenized tobacco layer while the particles are being removed from the carding of the drum on which the layer is formed and equalized.

An additional object of the invention is to provide the distributor with novel and improved means for converting a homogenized layer of randomly distributed lightweight and heavier tobacco shreds into a wide carpet which consists exclusively or practically exclusively of lightweight particles, with simultaneous segregation and collection of heavier particles.

A further object of the invention is to provide a distributor wherein the improved carpet forming means may but need not be associated with a homogenizing means of the type disclosed in the copending application Ser. No. 536,302.

The invention is embodied in an apparatus for the making and further processing of a homogeneous layer of fibrous particles, particularly in a distributor for shredded tobacco. The apparatus comprises a magazine or an analogous source of randomly distributed lightweight and heavier fibrous particles, a conveyor (e.g., a carded drum which is rotatable about a horizontal axis) for removing from the source a continuous layer of fibrous particles and for advancing the layer in a predetermined direction along an endless path which is located in a substantially vertical plane and has an apex (e.g., the topmost portion of the carding on the aforementioned drum), withdrawing means provided on the conveyor (such withdrawing means may include a carding having longer and shorter projections alternating with each other in the circumferential and/or axial direction of the conveyor) and arranged to remove fibrous particles from the source in a region which is located upstream of the apex, as considered in the predetermined direction, means (e.g., a rapidly rotating picker roller) for forcibly expelling at least the majority of fibrous particles of the layer from the endless path at or in the general area of the apex, and means for homogenizing the layer intermediate the region of removal of fibrous particles from the source and the expelling means.

The homogenizing means may but need not necessarily comprise a barrier having a first surface adjacent to and in contact with the exposed side of the layer in the endless path and a second surface which is adjacent to the first surface and extends substantially transversely of the path so as to face counter to the direction of forward movement of the layer whereby at least some particles at the exposed side of the layer are intercepted by and pile up at the second surface. The homogenizing means may further comprise means for moving the barrier transversely of the endless path and refuser means (e.g., a rotary paddle wheel) for moving the piled-up material in a second direction, preferably back to the source.

The novel features which are considered as characteristic of the invention are set forth in particular in the appended claims. The improved distributor itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a schematic elevational view of a distributor which embodies the invention and comprises homogenizing means of the type disclosed in my copending application Ser. No. 536,302.

DESCRIPTION OF THE PREFERRED EMBODIMENTS

The drawing shows a portion of a distributor for shredded tobacco 108 which is stored in a magazine 107 constituting a source of particulate fibrous material. The magazine 107 has an outlet opening 107*a* and contains a rotary loosening wheel 137 which is adjacent to the opening 107*a* and is driven by a suitable prime mover, e.g., by the main prime mover of a cigarette rod making machine which receives from the illustrated distributor a continuous tobacco stream. The magazine 107 further contains a lower photoelectric level detector 136 and an upper photoelectric level detector 134. These detectors respectively furnish signals when the supply of tobacco shreds 108 descends to a lowest permissible level and rises to a highest permissible level. Such signals control the operation of a feeding device, e.g., a pneumatic conveyor (not shown) which supplies tobacco shreads 108 into the magazine 107, and insure that the quantity of tobacco shreds invariably remains within a predetermined permissible range.

The conveyor of the distributor is a carded drum 101 which is driven by a horizontal shaft 138 and rotates in the direction indicated by arrow 103. The carding of the drum 101 comprises longer projections 106 which alternate with shorter projections 104, as considered in the circumferential and/or axial direction of the drum. These projections serve as a means for withdrawing from the magazine 107 a continuous layer of tobacco shreds 108 whereby such layer advances toward the apex 101*a* of the drum.

The homogenizing means of the distributor comprises an elongated strip-shaped barrier 109 which has a first surface 116 adjacent to and in contact with the exposed outer side of the tobacco layer on the carding 104, 106 of the drum 101, a second surface 118 which faces counter to the direction of rotation of the drum and extends transversely of the path of tobacco shreds which form the layer (the same as the surface 116), and a third surface 120 which is located opposite the surface 116 and extends into the path of movement of flexible blades or vanes 121 on a rotary refuser here shown as a paddle wheel 119. At least some shreds of the tobacco layer on the carding of the drum 101 are intercepted by and pile up along the surface 118, and such shreds are swept back into the magazine 107 by the blades 121. The surface 116 of the barrier 109 is preferably profiled (e.g., grooved) in a manner as disclosed in the copending application Ser. No. 536,302, and the entire barrier 109 is reciprocated transversely of the path of movement of the tobacco layer by a suitable prime mover (not shown), e.g., an electric motor which moves the barrier 109 through the medium of a crankshaft 113.

The means for expelling the shreds of the tobacco layer from the carding of the drum 101 comprises a rapidly rotating picker roller 139 which is mounted above the apex 101a and whose needles or teeth 141 expel the shreds from the carding 104, 106 so that the expelled shreds initially travel substantially tangentially of the periphery of the drum 101. The heavier particles 108*a* (they may consist of or include fragments of stem, ribs, birds' eyes, fragments of metals and/or sand) have longer flight spans and are intercepted by a trough-shaped receptacle 126 the bottom portion of which contains a rotating screw 126*a* serving to convey the particles 108*a* to a further processing station, e.g., into an apparatus for making sheets of reconstituted tobacco. The flight spans of the remaining (lightweight) particles 108*b* are shorter, and such particles are intercepted by the upper stretch of a wide conveyor belt 124 whereon the particles 108*b* form a wide carpet or sliver 127 of substantially constant weight and width. The leading edge of the carpet 127 is showered or propelled into a narrow channel of the type shown in FIG. 1 of the copending application Ser. No. 536,302 wherein the particles 108b descend onto a narrow foraminous belt to form thereon a growing tobacco stream which, when fully grown, is ready for conversion into a rod-like filler (either with or without trimming). The remnants of the tobacco layer are expelled from the carding 104, 106 by a second rapidly rotating picker roller 142 which transfers the expelled particles (normally lightweight fragments of tobacco leaf laminae) directly onto the right-most portion of the upper stretch of the belt 124. It will be noted that the second picker roller 142 is located upstream of the opening 107*a* and downstream of the picker roller 139, as considered in the direction indicated by arrow 103. The axes of the roller 139 and drum shaft 138 are preferably located in a common vertical plane. All rotary or otherwise movable parts of the distributor can receive motion from the main prime mover of the cigarette rod making machine. However, and as mentioned above, at least the crankshaft 113 can be driven by a separate motor.

The initial direction of travel of lightweight particles 108*b* (immediately to the left of the apex 101*a*) is identical or practically identical with the initial direction of travel of heavier particles 108*a*. However, the lightweight particles thereupon begin to sink due to lower inertia and are readily separated from the heavier particles 108*a* even though the magazine 107 contains the particles 108*a* and 108*b* in random distribution.

The purpose of the second picker roller 142 is to transfer from the drum 101 onto the belt 124 those lightweight tobacco particles which bypass the teeth 141 of the first picker roller 139 as well as lightweight particles 108*b* whose flight spans are so short that they descend back onto the carding of the drum 101 before they can reach the upper stretch of the belt 124.

An important advantage of the improved distributor is that the picker roller 139 replaces the conventional winnower or winnowers which are used in presently known distributors for classification of tobacco, i.e., for segregation of lightweight tobacco particles from heavier particles. As a rule, a winnower receives tobacco shreds from a picker roller and the winnower is normally closely adjacent to the upper stretch of the conveyor corresponding to the belt 124 so that there is relatively little room for classification of tobacco shreds according to their weight and/or size. By placing the picker roller 139 at or close to the apex 101*a* of the drum, I insure that the flight spans of heavier and lightweight particles are long, and this in turn guarantees a more reliable segregation of heavier particles from those which are desirable for the making of a superior rod-like tobacco filler. The classifying action is further enhanced due to the fact that the first or foremost portions of flight spans of the lightweight particles coincide with the first or foremost portions of flight spans of the heavier particles, i.e., the angle which the foremost portions of flight spans of lightweight particles make with the common vertical plane of the axes of drum 101 and picker roller 139 is identical with the angle between such plane and the foremost portions of flight spans of all heavier particles.

The placing of the picker roller 139 at or immediately adjacent to the apex 101*a* of the drum 101 insures that the particles of the homogenized layer of tobacco shreds have optimum flight spans without resorting to baffles, deflectors or analogous auxiliary components.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In an apparatus for producing and processing a homogeneous layer of fibrous particles, particularly in a distributor for shredded tobacco, the combination of a source arranged to store a supply of fibrous particles including first particles of greater weight in random distribution with second particles of lesser weight; a conveyor having means for withdrawing from said source a continuous layer of fibrous particles and for advancing said layer in a predetermined direction along an endless path located in a substantially vertical plane and having an apex, said withdrawing means coming into contact with fibrous material in a region which is located ahead of said apex, as considered in said direction, and said layer of fibrous particles having an exposed side; means for forcibly expelling at least the majority of fibrous particles from said path in the general area of said apex whereby the flight spans of said first particles are longer than the flight spans of said second particles and said first and second particles are separated from each other as a direct result of forcible expulsion of particles from said path by said expelling means; and means for homogenizing said layer intermediate said region and said expelling means, including a barrier having a first surface adjacent to and in contact with the exposed side of said layer and a second surface adjacent to said first surface, said second surface extending substantially transversely of said path and facing counter to said direction so that at least some fibrous particles at said exposed side of said layer are intercepted by and pile up at said second surface, means for moving said barrier substantially transversely of said path, and means for moving the piled-up particles in a second direction.

2. The combination of claim 1, wherein said conveyor is a drum rotatable about a substantially horizontal axis and said withdrawing means are projections provided at the periphery of said drum, said expelling means comprising a driven picker roller disposed at a level above said drum.

3. The combination of claim 2, wherein said drum and said roller have parallel axes located in a common vertical plane.

4. The combination of claim 2, further comprising a second picker roller adjacent to said path downstream of said first mentioned picker roller and operative to remove remnants of said layer from the projections of said drum upstream of said region.

5. The combination of claim 1, further comprising means for maintaining the quantity of fibrous particles in said source within a predetermined range.

6. The combination of claim 5, wherein said source includes a magazine and said means for maintaining the quantity of particles in said magazine within a predetermined range comprises upper and lower photoelectric level detectors respectively disposed at upper and lower levels and being operative to transmit signals when the quantity of fibrous material in said magazine respectively rises above said upper level and below said lower level.

7. The combination of claim 1, wherein said source comprises a magazine having an opening at said region, and further comprising means for loosening the contents of said magazine.

8. The combination of claim 7, wherein said loosening means comprises a rotary member mounted in said magazine adjacent to said opening.

9. A distributor for shredded tobacco, comprising a magazine having an outlet and arranged to store a supply of shredded tobacco including randomly distributed first and second particles of greater and lesser weight; a rotary drum having projections extending from the periphery thereof, said drum being rotatable about a substantially horizontal axis and having an apex, a portion of said periphery upstream of said apex being adjacent to said outlet so that said projections entrain from said magazine a continuous layer of shredded tobacco and said layer is transported toward said apex; means for homogenizing said layer between said outlet and said apex, including means for equalizing the thickness of said layer and means for returning surplus tobacco into said magazine; and a rotary member adjacent to said peripheral surface of said drum in the region of said apex and having means for forcibly expelling shredded tobacco from the periphery of said drum whereby the flight spans of said first particles are longer than the flight spans of said second particles and said first and second particles are separated from each other as a direct result of forcible expulsion from the periphery of said drum by said rotary member.

* * * * *